US008567534B2

(12) United States Patent
Zhang et al.

(10) Patent No.: US 8,567,534 B2
(45) **Date of Patent: *Oct. 29, 2013**

(54) THERMALLY STABLE POLYCRYSTALLINE DIAMOND CUTTING ELEMENTS AND BITS INCORPORATING THE SAME

(75) Inventors: Youhe Zhang, Spring, TX (US); Yuelin Shen, Spring, TX (US); Madapusi K. Keshavan, The Woodlands, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/449,243

(22) Filed: Apr. 17, 2012

(65) Prior Publication Data

US 2012/0199401 A1 Aug. 9, 2012

Related U.S. Application Data

(60) Continuation of application No. 12/830,136, filed on Jul. 2, 2010, now Pat. No. 8,157,029, which is a continuation of application No. 12/406,764, filed on Mar. 18, 2009, now Pat. No. 7,946,363, which is a division of application No. 11/350,620, filed on Feb. 8, 2006, now Pat. No. 7,533,740.

(60) Provisional application No. 60/651,341, filed on Feb. 8, 2005.

(51) Int. Cl.
*E21B 10/36* (2006.01)

(52) U.S. Cl.
USPC ..... 175/428; 175/432; 175/434; 51/297

(58) Field of Classification Search
USPC ..... 175/428, 432, 434; 51/297
See application file for complete search history.

(56) References Cited

U.S. PATENT DOCUMENTS

| | | | |
|---|---|---|---|
| 3,745,623 | A | 7/1973 | Wentorf, Jr. et al. |
| 4,108,614 | A | 8/1978 | Mitchell |
| 4,109,737 | A | 8/1978 | Bovenkerk |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |

(Continued)

FOREIGN PATENT DOCUMENTS

| | | |
|---|---|---|
| EP | 0 156 264 A2 | 10/1985 |
| EP | 0 157 278 A2 | 10/1985 |

(Continued)

OTHER PUBLICATIONS

Radtke, Robert, et al., Faster Drilling, Longer Life: Thermally Stable Diamond Drill Bit Cutters, *Summer 2004 Gas Tips.*, 2004, pp. 5-9.

*Primary Examiner* — Yong-Suk (Philip) Ro
(74) *Attorney, Agent, or Firm* — Christie, Parker & Hale, LLP.

(57) ABSTRACT

Cutting elements have substrates including end surfaces. TSP material layers extend over only a portion of the end surfaces or extend into the substrates below the end surfaces. Bits incorporate such cutting elements.

16 Claims, 12 Drawing Sheets

(56) References Cited

U.S. PATENT DOCUMENTS

| | | | | |
|---|---|---|---|---|
| 4,303,442 | A | 12/1981 | Hara et al. | |
| 4,311,490 | A | 1/1982 | Bovenkerk et al. | |
| 4,373,593 | A | 2/1983 | Phaal et al. | |
| 4,412,980 | A | 11/1983 | Tsuji et al. | |
| 4,440,246 | A | 4/1984 | Jürgens | |
| 4,481,016 | A | 11/1984 | Campbell et al. | |
| 4,498,549 | A | 2/1985 | Jürgens | |
| 4,505,746 | A | 3/1985 | Nakai et al. | |
| 4,515,226 | A | 5/1985 | Mengel et al. | |
| 4,525,179 | A | 6/1985 | Gigl | |
| 4,534,773 | A | 8/1985 | Phaal et al. | |
| 4,570,726 | A | 2/1986 | Hall | |
| 4,572,722 | A | 2/1986 | Dyer | |
| 4,602,691 | A | 7/1986 | Weaver | |
| 4,604,106 | A | 8/1986 | Hall et al. | |
| 4,605,343 | A | 8/1986 | Hibbs, Jr. et al. | |
| 4,621,031 | A | 11/1986 | Scruggs | |
| 4,636,253 | A | 1/1987 | Nakai et al. | |
| 4,664,705 | A | 5/1987 | Horton et al. | |
| 4,670,025 | A | 6/1987 | Pipkin | |
| 4,726,718 | A | 2/1988 | Meskin et al. | |
| 4,764,434 | A | 8/1988 | Aronsson et al. | |
| 4,766,040 | A | 8/1988 | Hillert et al. | |
| 4,784,023 | A | 11/1988 | Dennis | |
| 4,793,828 | A | 12/1988 | Burnand | |
| 4,797,138 | A | 1/1989 | Komanduri | |
| 4,828,582 | A | 5/1989 | Frushour | |
| 4,844,185 | A | 7/1989 | Newton, Jr. et al. | |
| 4,850,523 | A | 7/1989 | Slutz | |
| 4,861,350 | A | 8/1989 | Phaal et al. | |
| 4,899,922 | A | 2/1990 | Slutz et al. | |
| 4,919,220 | A | 4/1990 | Fuller et al. | |
| 4,931,068 | A | 6/1990 | Dismukes et al. | |
| 4,940,180 | A | 7/1990 | Martell | |
| 4,943,488 | A | 7/1990 | Sung et al. | |
| 4,944,772 | A | 7/1990 | Cho | |
| 4,976,324 | A | 12/1990 | Tibbitts | |
| 5,011,514 | A | 4/1991 | Cho et al. | |
| 5,028,177 | A * | 7/1991 | Meskin et al. | 408/145 |
| 5,030,276 | A | 7/1991 | Sung et al. | |
| 5,116,568 | A | 5/1992 | Sung et al. | |
| 5,127,923 | A | 7/1992 | Bunting et al. | |
| 5,135,061 | A | 8/1992 | Newton, Jr. | |
| 5,176,720 | A | 1/1993 | Martell et al. | |
| 5,199,832 | A | 4/1993 | Meskin et al. | |
| 5,205,684 | A | 4/1993 | Meskin et al. | |
| 5,238,074 | A | 8/1993 | Tibbitts et al. | |
| 5,264,283 | A | 11/1993 | Waldenström et al. | |
| 5,337,844 | A | 8/1994 | Tibbitts | |
| 5,370,195 | A | 12/1994 | Keshavan et al. | |
| 5,379,853 | A | 1/1995 | Lockwood et al. | |
| 5,464,068 | A | 11/1995 | Najafi-Sani | |
| 5,496,638 | A | 3/1996 | Waldenström et al. | |
| 5,510,193 | A | 4/1996 | Cerutti et al. | |
| 5,524,719 | A | 6/1996 | Dennis | |
| 5,560,716 | A | 10/1996 | Tank et al. | |
| 5,590,729 | A | 1/1997 | Cooley et al. | |
| 5,592,995 | A | 1/1997 | Scott et al. | |
| 5,607,024 | A | 3/1997 | Keith et al. | |
| 5,620,382 | A | 4/1997 | Cho et al. | |
| 5,624,068 | A | 4/1997 | Waldenström et al. | |
| 5,645,617 | A | 7/1997 | Frushour | |
| 5,667,028 | A | 9/1997 | Truax et al. | |
| 5,718,948 | A | 2/1998 | Ederyd et al. | |
| 5,722,497 | A * | 3/1998 | Gum et al. | 175/374 |
| 5,722,499 | A | 3/1998 | Nguyen et al. | |
| 5,833,021 | A | 11/1998 | Mensa-Wilmot et al. | |
| 5,862,873 | A | 1/1999 | Matthias et al. | |
| 5,887,580 | A | 3/1999 | Eyre | |
| 5,954,147 | A | 9/1999 | Overstreet et al. | |
| 5,957,228 | A | 9/1999 | Yorston et al. | |
| 5,979,578 | A | 11/1999 | Packer | |
| 6,009,963 | A | 1/2000 | Chaves et al. | |
| 6,011,232 | A | 1/2000 | Matthias | |
| 6,054,693 | A | 4/2000 | Barmatz et al. | |
| 6,082,474 | A | 7/2000 | Matthias | |
| 6,131,678 | A * | 10/2000 | Griffin | 175/434 |
| 6,145,607 | A | 11/2000 | Griffin et al. | |
| 6,193,001 | B1 | 2/2001 | Eyre et al. | |
| 6,202,770 | B1 | 3/2001 | Jurewicz et al. | |
| 6,202,771 | B1 | 3/2001 | Scott et al. | |
| 6,227,318 | B1 | 5/2001 | Siracki | |
| 6,234,261 | B1 | 5/2001 | Evans et al. | |
| 6,248,447 | B1 | 6/2001 | Griffin et al. | |
| 6,269,894 | B1 | 8/2001 | Griffin | |
| 6,283,234 | B1 | 9/2001 | Torbet | |
| 6,302,225 | B1 | 10/2001 | Yoshida et al. | |
| 6,315,067 | B1 | 11/2001 | Fielder | |
| 6,315,652 | B1 | 11/2001 | Snyder et al. | |
| 6,344,149 | B1 | 2/2002 | Oles | |
| 6,410,085 | B1 | 6/2002 | Griffin et al. | |
| 6,435,058 | B1 | 8/2002 | Matthias et al. | |
| 6,443,248 | B2 | 9/2002 | Yong et al. | |
| 6,488,106 | B1 | 12/2002 | Dourfaye | |
| 6,510,910 | B2 | 1/2003 | Eyre et al. | |
| 6,527,069 | B1 | 3/2003 | Meiners et al. | |
| 6,544,308 | B2 | 4/2003 | Griffin et al. | |
| 6,550,556 | B2 | 4/2003 | Middlemiss et al. | |
| 6,562,462 | B2 | 5/2003 | Griffin et al. | |
| 6,571,891 | B1 | 6/2003 | Smith et al. | |
| 6,585,064 | B2 | 7/2003 | Griffin et al. | |
| 6,589,640 | B2 | 7/2003 | Griffin et al. | |
| 6,592,985 | B2 | 7/2003 | Griffin et al. | |
| 6,601,662 | B2 | 8/2003 | Matthias et al. | |
| 6,739,214 | B2 | 5/2004 | Griffin et al. | |
| 6,739,417 | B2 | 5/2004 | Smith et al. | |
| 6,749,033 | B2 | 6/2004 | Griffin et al. | |
| 6,797,326 | B2 | 9/2004 | Griffin et al. | |
| 6,892,836 | B1 | 5/2005 | Eyre et al. | |
| 7,234,550 | B2 | 6/2007 | Azar et al. | |
| 7,426,969 | B2 | 9/2008 | Azar | |
| 2003/0019333 | A1 | 1/2003 | Scott | |
| 2005/0050801 | A1 | 3/2005 | Cho et al. | |
| 2005/0103533 | A1 * | 5/2005 | Sherwood et al. | 175/432 |
| 2005/0129950 | A1 | 6/2005 | Griffin et al. | |
| 2005/0230156 | A1 | 10/2005 | Belnap et al. | |
| 2005/0263328 | A1 | 12/2005 | Middlemiss | |
| 2005/0269139 | A1 | 12/2005 | Shen et al. | |
| 2006/0032677 | A1 | 2/2006 | Azar et al. | |
| 2006/0060390 | A1 | 3/2006 | Eyre | |
| 2006/0060392 | A1 | 3/2006 | Eyre | |
| 2006/0165993 | A1 | 7/2006 | Keshavan | |
| 2007/0079994 | A1 | 4/2007 | Middlemiss | |
| 2007/0169419 | A1 | 7/2007 | Davis et al. | |
| 2007/0181348 | A1 | 8/2007 | Lancaster et al. | |
| 2008/0223621 | A1 | 9/2008 | Middlemiss et al. | |
| 2008/0230280 | A1 | 9/2008 | Keshavan et al. | |

FOREIGN PATENT DOCUMENTS

| | | | |
|---|---|---|---|
| EP | 0 246 789 | A2 | 11/1987 |
| EP | 0 329 954 | A2 | 8/1989 |
| EP | 0 336 698 | A2 | 10/1989 |
| EP | 0 582 484 | A1 | 2/1994 |
| EP | 0 595 630 | A1 | 5/1994 |
| EP | 0 612 868 | A1 | 8/1994 |
| EP | 0 617 207 | A2 | 9/1994 |
| EP | 0 787 820 | A2 | 8/1997 |
| EP | 0 860 515 | A1 | 8/1998 |
| EP | 1 116 858 | A1 | 7/2001 |
| EP | 1 190 791 | A2 | 3/2002 |
| EP | 1 958 688 | A1 | 8/2008 |
| GB | 1 349 385 | | 4/1974 |
| GB | 2 048 927 | A | 12/1980 |
| GB | 2 204 625 | A | 11/1988 |
| GB | 2 261 894 | A | 6/1993 |
| GB | 2 268 768 | A | 1/1994 |
| GB | 2 270 492 | A | 3/1994 |
| GB | 2 270 493 | A | 3/1994 |
| GB | 2 323 398 | A | 9/1998 |
| GB | 2 351 747 | A | 1/2001 |
| GB | 2 367 081 | A | 3/2002 |
| GB | 2 408 735 | A | 6/2005 |
| GB | 2 413 575 | A | 11/2005 |

(56) References Cited

FOREIGN PATENT DOCUMENTS

| | | | |
|---|---|---|---|
| GB | 2 418 215 | A | 3/2006 |
| GB | 2 422 623 | A | 8/2006 |
| GB | 2 427 215 | A | 12/2006 |
| GB | 2 429 727 | A | 3/2007 |
| GB | 2 438 073 | A | 11/2007 |
| GB | 2 447 776 | A | 9/2008 |
| WO | WO 93/23204 | | 11/1993 |
| WO | WO 00/28106 | | 5/2000 |
| WO | WO 2004/040095 | A1 | 5/2004 |
| WO | WO 2004/106003 | A1 | 12/2004 |
| WO | WO 2004/106004 | A1 | 12/2004 |
| WO | WO 2007/042920 | A1 | 4/2007 |

* cited by examiner

THERMALLY STABLE POLYCRYSTALLINE DIAMOND CUTTING ELEMENTS AND BITS INCORPORATING THE SAME

CROSS-REFERENCE TO RELATED APPLICATIONS

This application is a continuation of U.S. application Ser. No. 12/830,136 filed on Jul. 2, 2010, issued as U.S. Pat. No. 8,157,029 on Apr. 17, 2012, which is a continuation of U.S. application Ser. No. 12/406,764, filed on Mar. 18, 2009, issued as U.S. Pat. No. 7,946,363 on May 24, 2011, which is a divisional of U.S. application Ser. No. 11/350,620, filed on Feb. 8, 2006, issued as U.S. Pat. No. 7,533,740 on May 19, 2009, which is based upon and claims priority to U.S. Provisional Application Ser. No. 60/651,341, filed on Feb. 8, 2005, the contents of which are fully incorporated herein by reference.

BACKGROUND OF THE INVENTION

This invention relates to cutting elements used in earth boring bits for drilling earth formations. More specifically, this invention relates to cutting elements incorporating thermally stable polycrystalline diamond (TSP). These cutting elements are typically mounted on a bit body which is used for drilling earth formations.

A cutting element 1 (FIG. 1), such as shear cutter mounted on an earth boring bit typically has a cylindrical cemented carbide body 10, i.e. a substrate, having an end face 12 (also referred to herein as an "interface surface"). An ultra hard material layer 18, such as polycrystalline diamond (PCD) or polycrystalline cubic boron nitride (PCBN) is bonded on the interface surface forming a cutting layer. The cutting layer can have a flat or curved interface surface 14. Cutting elements are mounted on pockets 2 of an earth boring bit, such a drag bit 7, at an angle 8, as shown in FIGS. 1 and 2 and contact the earth formation 11 during drilling along edge 9 over cutting layer 18.

Generally speaking, the process for making a cutting element employs a substrate of cemented tungsten carbide where the tungsten carbide particles are cemented together with cobalt. The carbide body is placed adjacent to a layer of ultra hard material particles such as diamond or cubic boron nitride (CBN) particles within a refractory metal can, as for example a niobium can, and the combination is subjected to a high temperature at a high pressure where diamond or CBN is thermodynamically stabled. This results in the re-crystallization and formation of a polycrystalline diamond or polycrystalline cubic boron nitride ultra hard material layer on the cemented tungsten carbide substrate, i.e., it results in the formation of a cutting element having a cemented tungsten carbide substrate and an ultra hard material cutting layer. The ultra hard material layer may include tungsten carbide particles and/or small amounts of cobalt. Cobalt promotes the formation of polycrystalline diamond (PCD) or polycrystalline cubic boron nitride (PCBN). Cobalt may also infiltrate the diamond of CBN from the cemented tungsten carbide substrate.

The cemented tungsten carbide substrate is typically formed by placing tungsten carbide powder and a binder in a mold and then heating the binder to melting temperature causing the binder to melt and infiltrate the tungsten carbide particles fusing them together and cementing the substrate. Alternatively, the tungsten carbide powder may be cemented by the binder during the high temperature, high pressure process used to re-crystallize the ultra hard material layer. In such case, the substrate material powder along with the binder are placed in the can, forming an assembly. Ultra hard material particles are provided over the substrate material to form the ultra hard material polycrystalline layer. The entire assembly is then subjected to a high temperature, high pressure process forming the cutting element having a substrate in a polycrystalline ultra hard material layer over it.

PCD ultra hard material cutting element cutting layers have low thermal stability and as such have lower abrasive resistance which is a detriment in high abrasive applications. Consequently, cutting elements are desired having improved thermal stability for use in high abrasive applications.

SUMMARY OF THE INVENTION

In an exemplary embodiment a cutting element is provided having a substrate including an end surface and a periphery, where the end surface extends to the periphery. A TSP material layer is formed over only a portion of the end surface and extends to the periphery. In another exemplary embodiment, the cutting element further includes a depression formed on the end surface and the TSP material layer extends within the depression. In a further exemplary embodiment, a channel is formed bounded on one side by the TSP material layer and on an opposite side by the end surface. In one exemplary embodiment, the channel extends to two separate locations on the periphery.

In a further exemplary embodiment, the TSP layer has a TSP layer periphery and only a single continuous portion of the TSP layer periphery extends to the periphery of the substrate. In yet another exemplary embodiment an ultra hard material layer is formed over the end surface adjacent the TSP material layer. In yet a further exemplary embodiment, the end surface portion not covered by the TSP material layer is exposed.

In another exemplary embodiment, the TSP is mechanically locked with the cutting element. In a further exemplary embodiment, an elongated member penetrates at least part of the TSP layer and at least part of the cutting element locking the TSP layer to the cutting element. In yet another exemplary embodiment, the elongated member penetrates the TSP material layer and the substrate on either side of the TSP material layer locking the TSP material layer to the substrate. In another exemplary embodiment, a second substrate portion cooperates with the substrate and the TSP layer to mechanically lock the TSP layer to the substrate.

In one exemplary embodiment, a depression is formed on the end surface of the substrate having a dove-tail shape in cross-section. With this exemplary embodiment the TSP material layer also includes a dove-trail shaped portion in cross-section extending within the depression locking with the depression. In another exemplary embodiment the cutting element includes an ultra hard material layer mechanically locking the TSP material layer to the substrate.

In yet a further exemplary embodiment, the TSP layer interfaces with the substrate along an non-uniform interface. In yet another exemplary embodiment, the TSP layer interfaces with the substrate along a uniform non-planar interface.

In one exemplary embodiment, the portion of the end surface over which is formed the TSP material layer is depressed and the cutting element further includes an ultra hard material layer formed over another portion of the end surface. The TSP material layer and the ultra hard material layer each have an upper surface opposite their corresponding surfaces facing the end surface such that the upper surface of the TSP material layer and the upper surface of the ultra hard material layer define a uniform cutting element upper surface.

In another exemplary embodiment the portion of the end surface over which is formed the TSP material layer is depressed forming a depression and the TSP material layer extends diametrically across the end surface within the depression. The cutting element further includes a first ultra hard material layer and a second ultra hard material layer over other portions of the end surface. The first ultra hard material layer extends from a first side of the TSP material layer and the second ultra hard material layer extends from a second side of the TSP material layer opposite the first side. In yet another exemplary embodiment, the cutting element further includes a rod penetrating the substrate and the TSP material layer, locking the TSP material layer to the substrate.

In another exemplary embodiment the cutting element further includes a second TSP material layer formed over another portion of the end surface such that the second TSP material layer is spaced apart from the TSP material layer and extends to the periphery. The two TSP material layers may have the same or different properties. In yet another exemplary embodiment, the cutting element further includes an ultra hard material layer formed over yet another portion of the substrate end surface such that the ultra hard material layer is adjacent to both TSP material layers.

In another exemplary embodiment a cutting element is provided having a substrate having an end surface and a periphery. A TSP material layer extends into the substrate below the end surface. In a further exemplary embodiment, the TSP material layer extends obliquely into the substrate. In another exemplary embodiment, the substrate includes a pocket and the TSP material layer extends in the pocket. In yet a further exemplary embodiment, the TSP material layer includes a first surface opposite a second surface such that the first surface faces in a direction toward the end surface, and such that a portion of the first surface is exposed. In yet another exemplary embodiment, a portion of the substrate extending to the periphery is removed defining a cut-out and the exposed first surface portion of the TSP material layer extends in the cut-out. In another exemplary embodiment, the TSP material layer extends obliquely away from the end surface in a direction away from the cut-out. In yet a further exemplary embodiment, TSP layer does not extend radially beyond the substrate periphery. In another exemplary embodiment, a peripheral surface extends from the first surface of the TSP material layer and an inside angle between the first surface and the TSP layer peripheral surface is less than 90°. In yet a further exemplary embodiment, a second TSP material layer extends into the substrate below the end surface.

In another exemplary embodiment a cutting element is provided having a substrate having a first portion and a second portion. The cutting element also includes a TSP material portion. In this exemplary embodiment, the first and second portions cooperate with each to mechanically lock the TSP material portion to the substrate. In a further exemplary embodiment, the substrate has an end surface and the TSP portion only extends along a portion of the end surface.

In yet another exemplary embodiment a drill bit is provide including a body. Any of the aforementioned exemplary embodiment cutting elements is mounted on the bit body. In yet a further exemplary embodiment, a drill bit is provided having a body having a rotational axis and a plurality of cutting elements mounted on the body. Each cutting element has a cutting layer having a cutting edge formed from a TSP material for cutting during drilling. The TSP material forming the cutting edges of cutting elements mounted radially farther form the rotational axis is thicker than TSP material forming the cutting edges of cutting elements mounted radially closer to the rotational axis.

DETAILED DESCRIPTION OF THE INVENTION

In an exemplary embodiment, a cutting element for use in a bit is provided having a cutting layer, a portion of a cutting layer or a cutting layer surface formed from thermally stable polycrystalline diamond (TSP).

Use of TSP in cutting elements is described in U.S. Pat. No. 7,234,550, issued on Jun. 26, 2007, and U.S. Pat. No. 7,426,969, issued on Sep. 23, 2008, and which are fully incorporated herein by reference.

TSP is typically formed by "leaching" the cobalt from the diamond lattice structure of polycrystalline diamond. When formed, polycrystalline diamond comprises individual diamond crystals that are interconnected defining a lattice structure. Cobalt particles are often found within the interstitial spaces in the diamond lattice structure. Cobalt has a significantly different coefficient of thermal expansion as compared to diamond, and as such upon heating of the polycrystalline diamond, the cobalt expands, causing cracking to form in the lattice structure, resulting in the deterioration of the polycrystalline diamond layer. By removing, i.e., by leaching, the cobalt from the diamond lattice structure, the polycrystalline diamond layer because more heat resistant. However, the polycrystalline diamond layer becomes more brittle. Accordingly, in certain cases, only a select portion, measured either in depth or width, of the polycrystalline layer is leached in order to gain thermal stability without losing impact resistance.

In other exemplary embodiment, TSP material is formed by forming polycrystalline diamond with a thermally compatible silicon carbide binder instead of cobalt. "TSP" as used herein refers to either of the aforementioned types of TSP materials.

Figure 1:
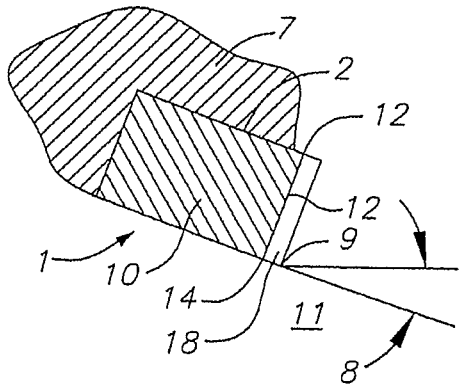
FIG.1 PRIOR ART
FIG. 1 is a cross-sectional view taken along arrow 1-1 in FIG. 2, depicting a cutting element mounted on a bit body.
Figure 2:
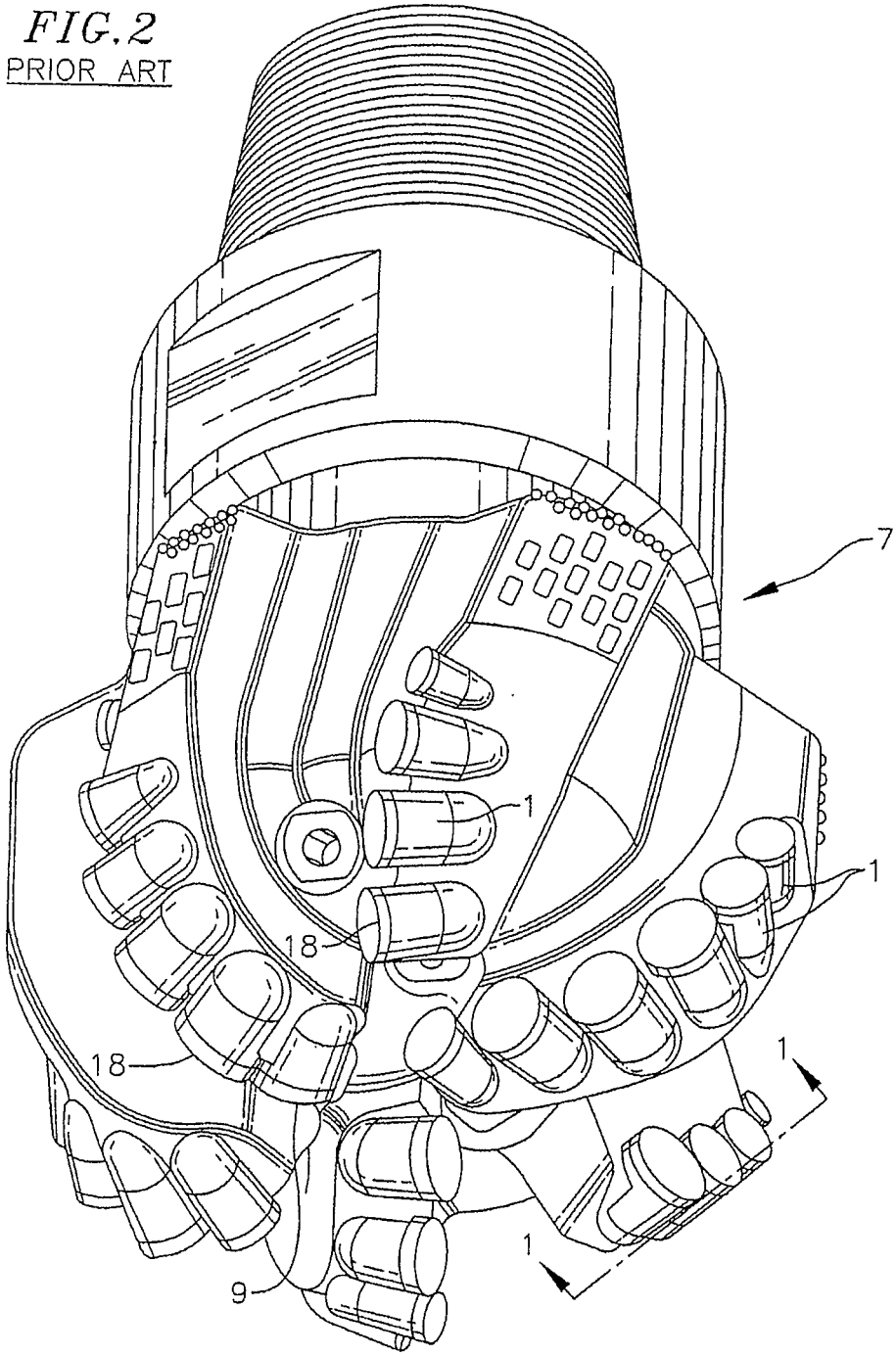
FIG. 2 PRIOR ART
FIG. 2 is a perspective view of a bit incorporating cutting elements.
Figure 3:
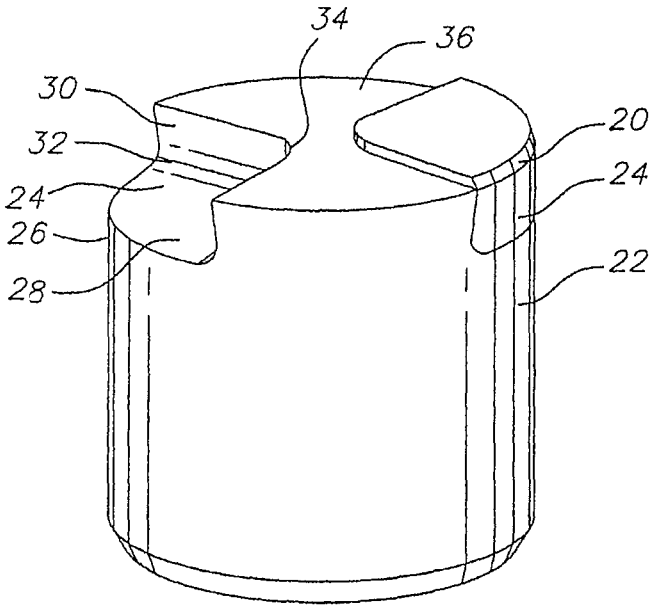
FIG. 3 is side view of an exemplary embodiment cutting element of the present invention with one of two TSP layers attached.

In one exemplary embodiment of the present invention, a cutting element is provided where TSP is used to form a cutting layer. In the exemplary embodiment, shown in FIG. 3, the TSP material extends along a section of the substrate 22 so as to make contact with the earth formations during drilling. In one exemplary embodiment as shown in FIG. 3, a generally V-shaped depression 24 is formed on the substrate end surface and extends to the periphery 26 of the substrate. In the exemplary embodiment shown in FIG. 3, the TSP layer extends above the end surface 36 of the substrate. In other exemplary embodiments, the TSP layer may be coplanar with the end surface of the substrate or extend to a level below the end surface of the substrate.

The terms "upper," "lower," "above" and "below" are used herein as relative terms to describe the relative location of parts and not the exact locations of such parts.

A TSP material layer 20 is bonded to the depression. In an exemplary embodiment, one or more depressions may be formed and a TSP material layer may be bonded in each. In the exemplary embodiment shown in FIG. 3, two depressions are formed to accommodate two TSP material layers. In this regard, as the TSP wears during use, the cutting element may be rotated in the bit pocket so as to position the other TSP layer to make contact with the earth formations and do the cutting.

In the exemplary embodiment shown in FIG. 3, the generally V-shaped depressions have a relatively flat, i.e., uniform, base 28 and a generally V-shaped edge 30 which interfaces with the flat base with a rounded section 32. The vertex 34 of the V-shaped section is also rounded. By rounding these sections, the magnitude of the stresses generated in such sections is reduced. In alternate exemplary embodiments, the base and/or the edge and/or the rounded sections may be non-uniform.

As used herein, a "uniform" interface (or surface) is one that is flat or always curves in the same direction. This can be stated differently as an interface having the first derivative of slope always having the same sign. Thus, for example, a conventional polycrystalline diamond-coated convex insert for a rock bit has a uniform interface since the center of curvature of all portions of the interface is in or through the carbide substrate.

On the other hand, a "non-uniform" interface is defined as one where the first derivative of slope has changing sign. An example of a non-uniform interface is one that is wavy with alternating peaks and valleys. Other non-uniform interfaces may have dimples, bumps, ridges (straight or curved) or grooves, or other patterns of raised and lowered regions in relief.

Figure 4:
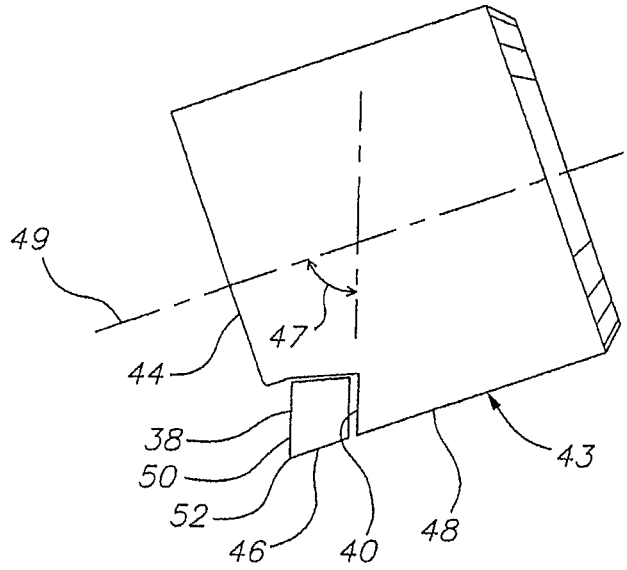
FIG. 4 is a side view of another exemplary embodiment cutting element of the present invention.

In another exemplary embodiment shown in FIG. 4, a TSP layer 38 is positioned in a depression or cut-out 40 formed on a substrate 43. A pocket 42 extends from the cut-out 40 inward into the substrate 43, as for example shown in FIG. 5. The pocket has a height slightly greater than the thickness of the TSP layer 38. The TSP layer is slid into the pocket and bonded or brazed thereto. In this regard, a mechanical lock is provided by the substrate for retaining the TSP material layer on the substrate. In other words, the pocket provides a lock for retaining the TSP layer within the substrate. The mechanical lock reduces the risk of shearing failure of the brazing bond between the TSP layer and the substrate.

Figure 5:
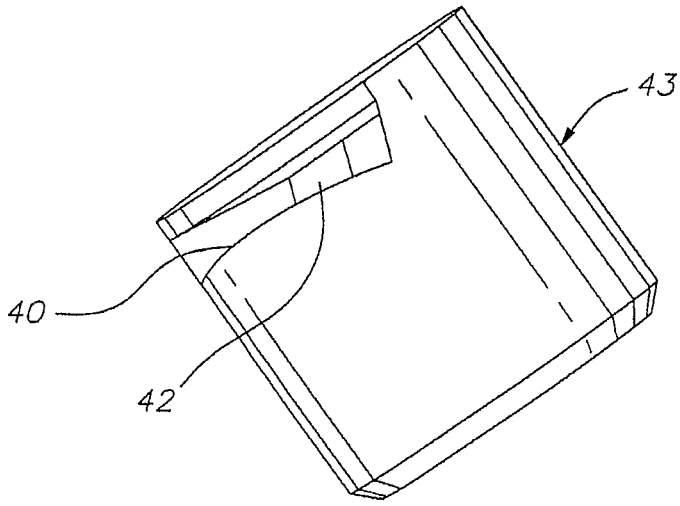
FIG. 5 is a perspective view of the substrate of the cutting element shown in FIG. 4 prior to the attachment of the TSP layer.

In the exemplary embodiment shown in FIGS. 4 and 5, the pocket 42 extends into the substrate at an angle, i.e., it extends inward and downward. In this regard, the TSP layer 38 extends into the pocket at an non perpendicular angle 47 relative to a central axis 49 of the substrate 43. An end 46 of the TSP layer is formed so that it will be coincident with the periphery 48 of the substrate 43. Consequently, an upper surface 50 of the TSP layer 38 extends at an acute angle relative to the end 46 of the TSP defining a cutting edge 52.

In an alternate exemplary embodiment, further TSP layers may be bonded to other pockets formed on the substrate. For example, the substrate may be formed with two or more pockets which may be equidistantly spaced and each of which supports a separate layer of TSP. In this regard, as one layer of TSP wears, the cutting element may be rotated within a pocket of a bit exposing another TSP layer for cutting the earth formations.

Since the thermal stability of a TSP material may be a function of the amount of cobalt in the TSP material, in an effort to prevent cobalt from the tungsten carbide substrate from infiltrating the TSP material, in any of the aforementioned exemplary embodiments, the TSP material is bonded to the substrate by brazing. In one exemplary embodiment, the TSP material is brazed using microwave brazing as for example described in the paper entitled "Faster Drilling, Longer Life: Thermally Stable Diamond Drill Bit Cutters" by Robert Radtke, Richard Riedel and John Hanaway of Technology International, Inc., and published in the Summer 2004 edition of GasTIPS and in U.S. Pat. No. 6,054,693, both of which are fully incorporated herein by reference. Other methods of brazing includes high pressure, high temperature brazing and furnace or vacuum brazing.

In another exemplary embodiment, cutting elements are provided having cutting layers comprising both an ultra hard material layer, such a PCD layer or PCBN layer (individually or collectively referred to herein as an "ultra hard material layer"), as well as a TSP layer. In this regard, a cutting layer may be provided having both the higher thermal stability for high abrasive cutting of the TSP material as well as the high impact strength of the ultra hard material.

Figure 6:
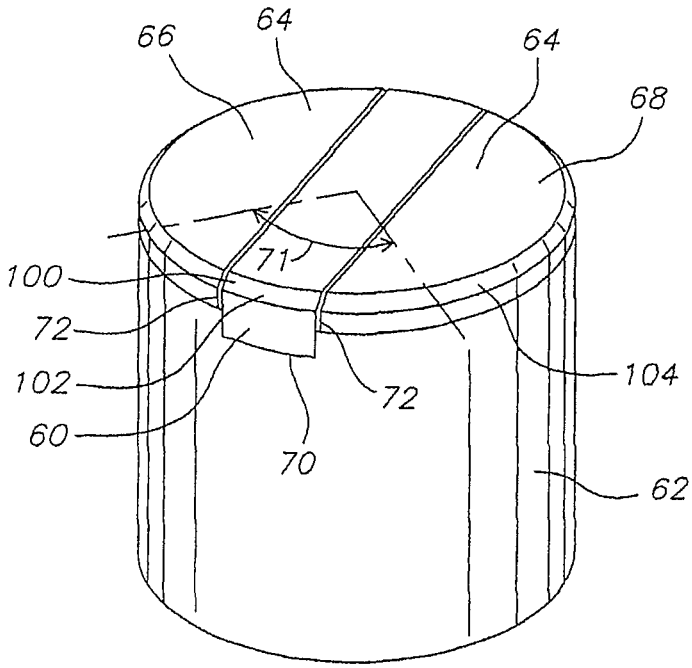
FIG. 6 is a perspective view of another exemplary embodiment cutting element of the present invention.

In one exemplary embodiment, as shown in FIG. 6, a TSP layer 60 forming a strip is bonded to the substrate 62 such that it divides an ultra hard material layer 64 into two separate layer sections 66, 68. In this exemplary embodiment, the TSP layer 60 extends into a groove 70 formed into the substrate material and it is brazed to such groove. A gap 72 may exist at each boundary between the TSP layer 60 and each ultra hard material section 66, 68. In this exemplary embodiment, since the TSP layer is brazed to the substrate, the groove 70 provides for more substrate surface area for brazing with the TSP layer.

Figure 7:
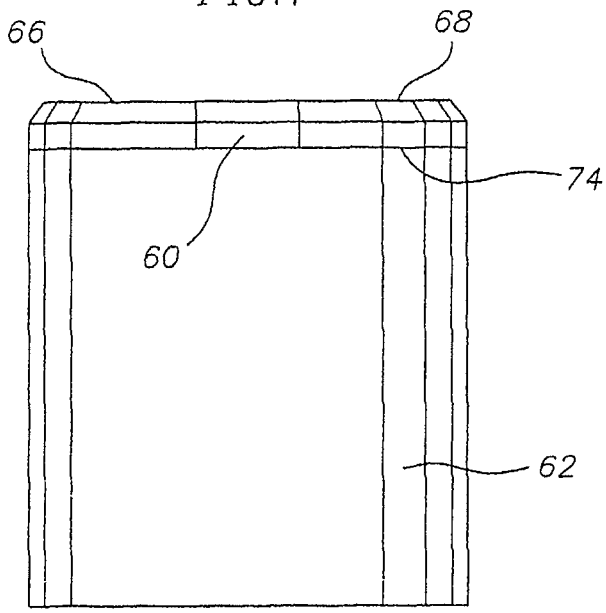
FIG. 7 is a front view of another exemplary embodiment cutting element of the present invention.
Figure 8:
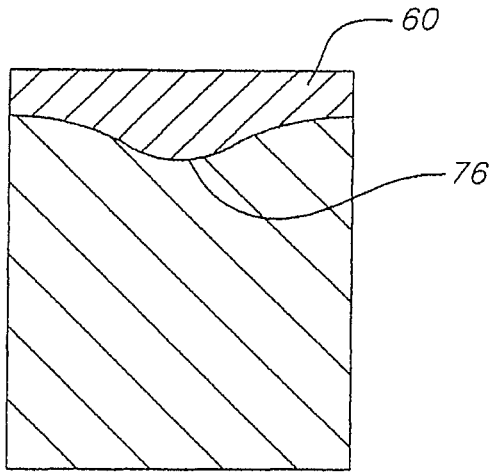
FIG. 8 is a cross-sectional view of another exemplary embodiment cutting element of the present invention.
Figure 9:
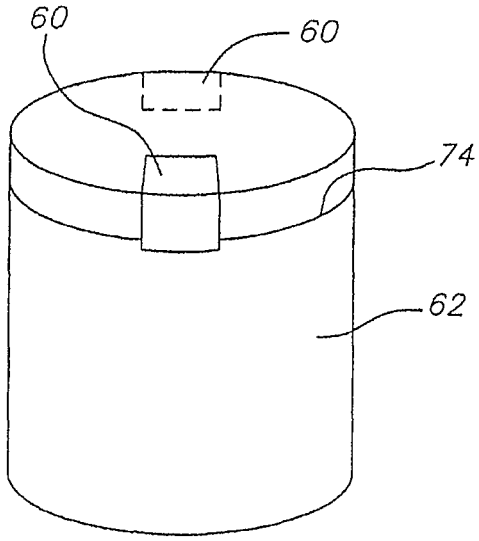
FIG. 9 is a perspective view of another exemplary embodiment cutting element of the present invention.
Figure 10:
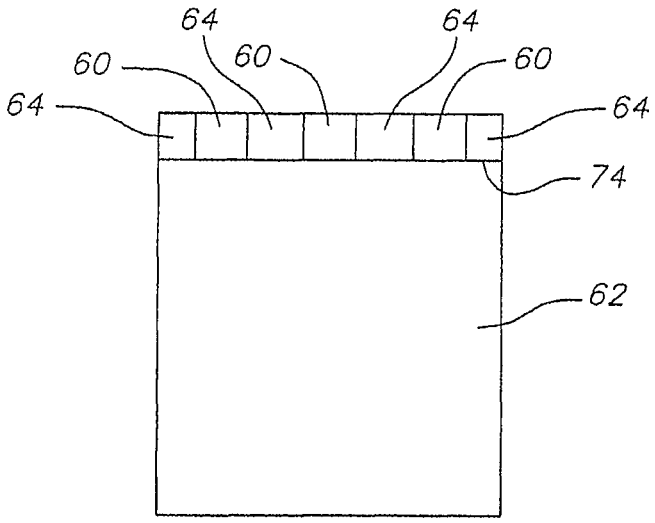
FIG. 10 is a front view of another exemplary embodiment cutting element of the present invention.
Figure 11:
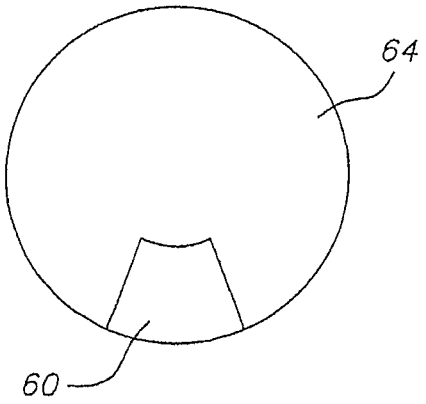
FIGS. 11 and 12 have top views of other exemplary embodiment cutting elements of the present invention.
Figure 12:
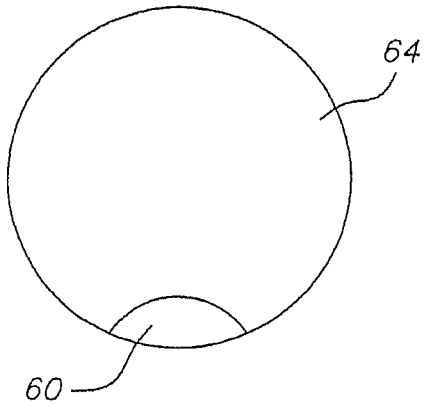

In another exemplary embodiment as shown in FIG. 7, a groove is not incorporated on the substrate interface surface 74 and the TSP layer is bonded to the substrate interface surface 74. In other exemplary embodiments, the TSP layer 60 has a convex bottom surface 76, as for example shown in FIG. 8, or a concave bottom surface (not shown). In other exemplary embodiments, as shown in FIG. 9, the TSP layer 60 may span only across a portion of the substrate interface surface 74. In other exemplary embodiments, more than one TSP layer 60 may be incorporated in the cutting element, as for example shown in FIG. 10. Each of the multiple TSP layers may span an entire chord of the interface surface 74 of the substrate 62 or may span a portion of the chord as for example shown in FIG. 9. Furthermore, the TSP layer or layers 60 may have various shapes in plan view. For example they may be rectangular as shown in FIGS. 6 and 7, or generally trapezoidal as shown in FIG. 11 or generally circular or elliptical as for example shown in FIG. 12. Furthermore the TSP material layers may have the same or different properties. For example, in a cutting element, one TSP layer may be formed with coarser grain diamond particles than another TSP layer or one TSP layer may be formed by leaching whereas the other may be formed using a silicon carbide binder.

Figure 13:
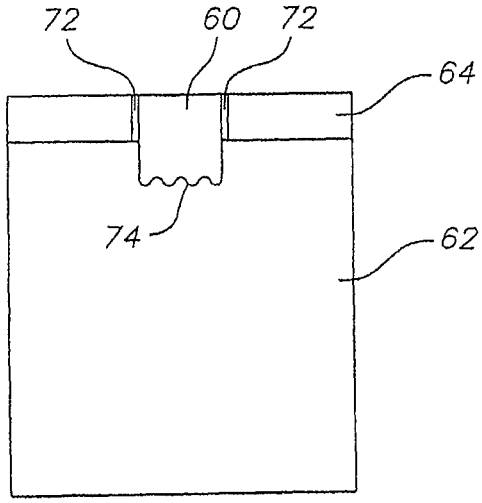
FIGS. 13 and 14 are front views other exemplary embodiment cutting elements of the present invention.
Figure 14:
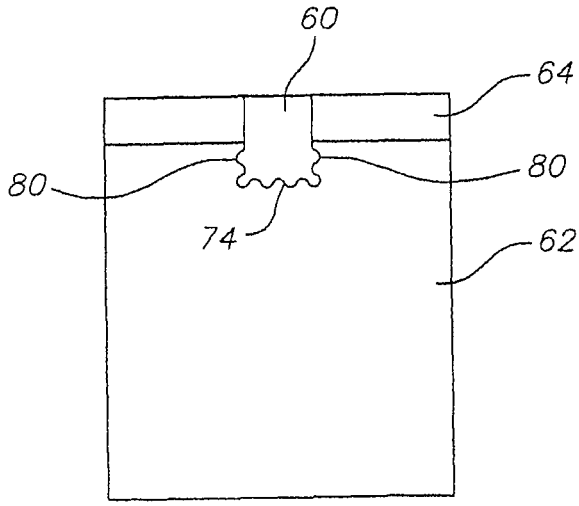
Figure 15:
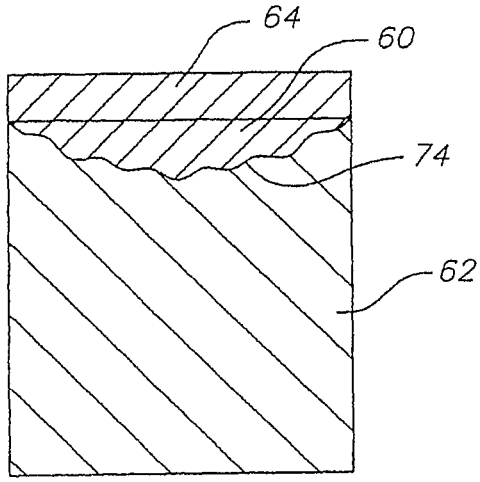
FIG. 15 is a cross-sectional view of another exemplary embodiment cutting element of the present invention.

In other exemplary embodiments, as for example shown in FIGS. 13-15, the entire or a portion of bottom surface of the TSP layer 74 interfacing with the substrate may be non-uniform. In addition any other surface or portion thereof of the TSP layer interfacing with the substrate may be non-uniform, as for example the side surfaces 80 of the TSP layer shown in FIG. 15. By using a non-uniform surfaces interfacing with the substrate material, a larger brazing area is provided between the TSP layer and the substrate allowing for a stronger braze bond between the TSP layer and the substrate. In addition, any coefficient of thermal expansion mismatch effects between the TSP and the substrate are reduced by the non-uniform interface. Moreover, the shear strength of bond between the TSP layer and substrate is also improved by the non-uniform interface. In another exemplary embodiment, a portion of the TSP material layer interfacing with an ultra hard material layer over the substrate may also be non-planar or non-uniform.

Figure 16:
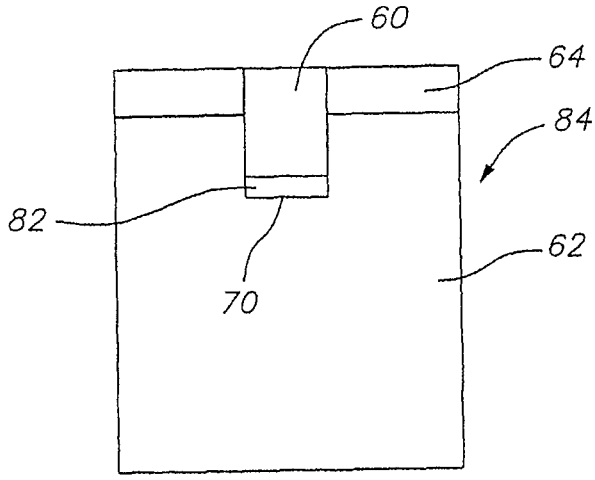
FIGS. 16 and 17 are front end views of other exemplary embodiment cutting elements of the present invention.

In yet a further exemplary embodiment as shown in FIG. 16, a channel 82 is defined between the TSP layer 60 and the substrate to allow for cooling fluids to penetrate the cutting element 84. In another exemplary embodiment, the channel traverses across the entire cutting element. In the exemplary embodiment shown in FIG. 16, the TSP layer is positioned in the groove 70 formed on the substrate 62 such that the base of the TSP layer is spaced apart from the base of the substrate groove 70 defining the channel 82. The sides of the TSP layer are brazed to the substrate groove.

Figure 17:
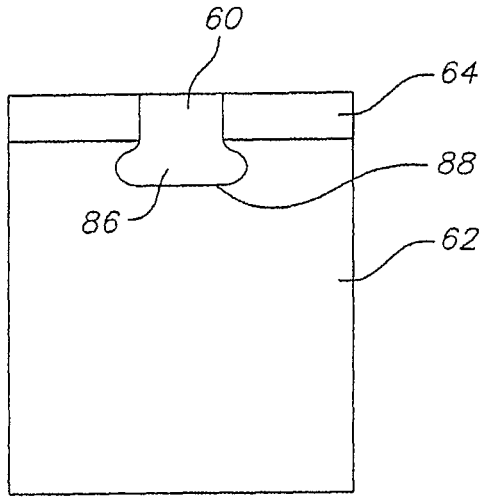
Figure 18:
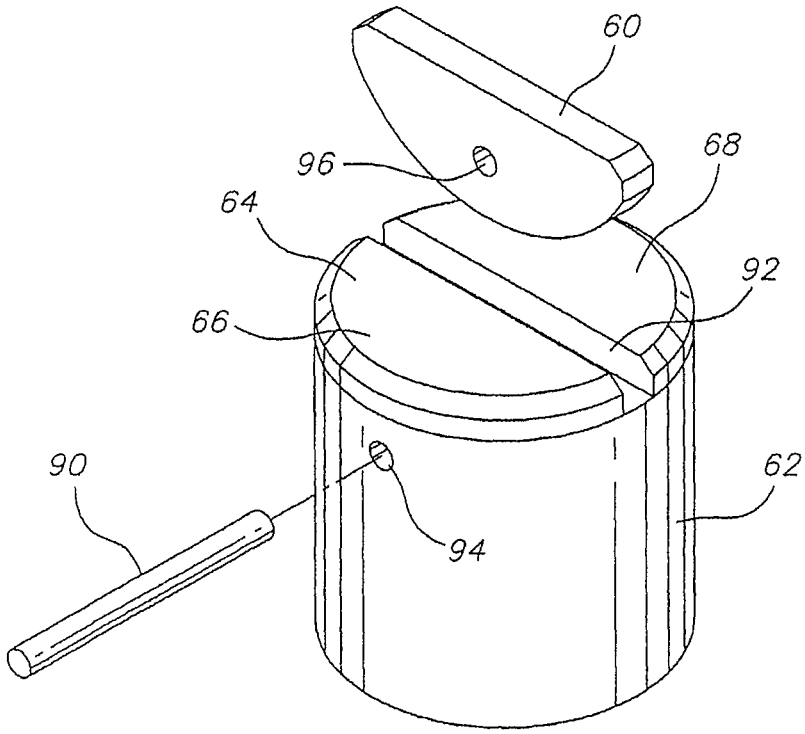
FIG. 18 is an exploded perspective view of another exemplary embodiment cutting element of the present invention.

In yet another exemplary embodiment, the TSP layer mechanically locks with the substrate and/or the PCD cutting layer. For example as shown in FIG. 17, to provide for a mechanical lock, the TSP layer includes a dove-tail portion 86 interfacing with a dove-tail depression 88 formed on the substrate 62. In another exemplary embodiment as shown in FIG. 18, a pin 90 is used to mechanically lock the TSP layer 60 to the substrate 62. The TSP layer 60 is fitted in a slot 92 formed thorough the ultra hard material layer 64 and into the substrate 62. The TSP layer may be brazed to the substrate using any of the aforementioned or other known brazing techniques. The pin 90 is fitted through an opening 94 transversely through the substrate 62 and penetrates an opening 96 formed transversely through the TSP layer. The opening 94 may extend through the substrate on opposite sides of the TSP layer. In such case, the pin will penetrate the TSP layer as well as the substrate on opposite sides of the TSP layer. The pin may be press fitted into any or all of the openings. In another exemplary embodiment, the pin may have external threads and may be threaded into any of the openings. In another exemplary embodiment, the pin itself may be brazed using any of the aforementioned or other known appropriate brazing methods. The pin may be formed from various materials. In an exemplary embodiment, the pin is formed from the same type of material as the substrate. In another exemplary embodiment, the pin is formed from a different type of substrate material than the substrate material forming the substrate.

In yet a further exemplary embodiments, the cutting edge 100 of the TSP layer 60 and/or the ultra hard material layer 64 may be chamfered. By forming a chamfer 102 (FIG. 6) on the cutting edge of the TSP layer 60, the impact strength of the TSP layer is improved. In an exemplary embodiment, the chamfer is maximum at the TSP layer cutting edge and then decreases as it extends on the ultra hard material layer 64 cutting edge on either side of the TSP layer, as shown in FIG. 6. In other words chamfer 102 formed on the TSP layer cutting edge is greater than the chamfer 104 formed on the cutting edge of the ultra hard material layer sections 66, 68 on either side of the TSP layer. In the shown exemplary embodiment, the chamfer 104 formed on the ultra hard material layer sections 66 and 68 on either side of the TSP layer also decrease as the distance away from the TSP layer increases.

In an exemplary embodiment, the chamfer spans an angle 71 of at least 60° around the cutting edge. The variance in the cutting edge chamfer improves the overall impact strength of the TSP/PCD cutting layer.

The effects of a chamfer on the cutting edge are described in U.S. Provisional Application 60/566,751 filed on Apr. 30, 2004, and on U.S. application Ser. No. 11/117,648, filed on Apr. 28, 2005, and claiming priority on U.S. Provisional Application 60/566,751, the contents of both of which are fully incorporated herein by reference.

The substrates of the exemplary embodiment cutting elements described herein maybe formed as cylindrical substrates using conventional methods. The substrates are then cut or machined to define the grooves or depressions to accommodate the TSP layer(s) using various known methods such as electrical discharge machining (EDM). In another exemplary embodiment, the substrates are molded with the appropriate grooves or depressions. This may be accomplished by using mold materials which can be easily removed to define the appropriate cut-outs or depressions to accommodate the TSP layer(s). One such mold material may be sand.

Similarly, a cutting element may be formed using conventional sintering methods having an ultra hard material layer. EDM is then used to cut the ultra hard material layer and any portion of the substrate, as necessary, for accommodating the TSP layer. The TSP layer is then bonded to the substrate using any of the aforementioned or any other suitable known brazing techniques.

In an alternate exemplary embodiment, the substrate is provided with the appropriate grooves or cut-outs as necessary. The substrate is placed in the appropriate refractory metal can. A mold section made from a material which can withstand the high temperature and pressures of sintering and which can be easily removed after sintering is used to occupy the location that will be occupied by the TSP layer. Diamond particles are then placed over the substrate along with the appropriate binder. The can is then covered and sintered such that the diamond material bonds to the substrate. The mold section is then removed defining the location for the attachment of the TSP layer.

Figure 19:
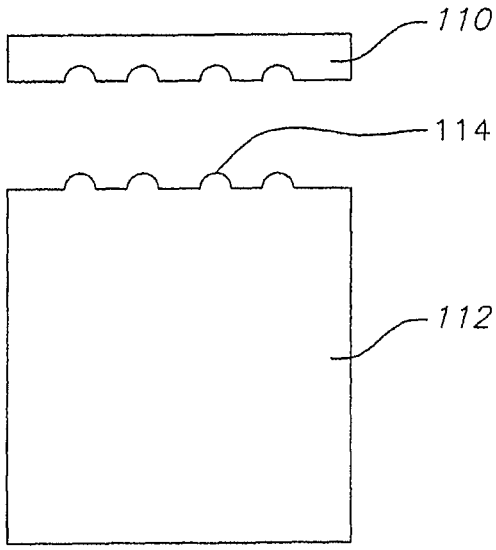
FIG. 19 is an exploded view of a PCD layer and substrate used to form TSP.

In an alternate exemplary embodiment, the TSP may be initially formed as a polycrystalline diamond layer formed over a substrate using known sintering methods. In an exemplary embodiment where the TSP is required to have a non-uniform interface for interfacing with the substrate, a PCD layer 110 is formed over a substrate 112 having the desired non-uniform interface 114, as for example shown in FIG. 19. After sintering and the formation of the PCD layer on the substrate, the substrate is removed so as to expose the non-uniform interface. The PCD layer is then leached as necessary to form the appropriate TSP layer. The PCD layer may also be leached prior to removal from the substrate. Either prior to leaching or after leaching, the PCD material may be cut to the appropriate size, if necessary. In another exemplary embodiment, the TSP is formed with the appropriate silicone carbide binder on a tungsten carbide substrate with the requisite, i.e., uniform or non-uniform, interface surface. The substrate is then removed so as to expose the TSP with the appropriate interface surface.

Some exemplary TSP materials that may be used with a cutting element of the present invention are disclosed in U.S. Pat. Nos. 4,224,380; 4,505,746; 4,636,253; 6,132,675; 6,435,058; 6,481,511; 6,544,308; 6,562,462; 6,585,064 and 6,589,640 all of which are fully incorporated herein by reference. The geometry of the TSP materials may also be changed by cutting the TSP materials using known methods such as EDM.

In a further exemplary embodiment, the cutting elements of the present invention may be strategically positioned at different locations on a bit depending on the required impact and abrasion resistance. This allows for the tailoring of the cutting by the bit for the earth formation to be drilled. For example, the cutting elements furthest away from the rotational axis of the bit may have more TSP material at their cutting edge. This may be accomplished by using wider portions of TSP material. The cutting elements closer to the rotational axis of the bit may have narrower portions of TSP material occupying the cutting edge. In other words, in an exemplary embodiment, the cutting elements furthest from rotational axis of the bit which travel at a higher speed will require greater abrasion resistance and may be made to include more TSP material at their cutting edge, whereas the cutting elements closer to the rotational axis of the bit which travel at a slower speed will require more impact resistance and less abrasion resistance. Thus, the latter cutting elements will require more ultra hard material at their cutting edge making contact with the earth formations. As can be seen with the present invention, the amount of TSP material forming the cutting edge of a cutting element may be varied as necessary for the task at hand.

In other exemplary embodiments, inserts incorporating TSP materials in accordance with the present invention may be used in rotary cone bits which are used in drilling earth formations.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A method for forming a cutting element comprising:

obtaining a substrate having an end surface, a periphery, and a depression on the end surface extending only to a first section of the periphery, said depression having opposite edges on the end surface extending away from each other in a direction towards the first section of the periphery; and attaching a pre-formed thermally stable polycrystalline (TSP) material layer to said end surface within said depression and extending to said first section of the periphery, wherein said TSP material layer is a polycrystalline diamond layer selected from the group of polycrystalline diamond layers consisting essentially of polycrystalline diamond layers having at least some of a cobalt in such polycrystalline diamond layers leached and polycrystalline diamond layers formed with a thermally compatible silicone carbide binder.

2. The method as recited in claim 1, wherein said depression is a first depression and wherein the end surface comprises a second depression spaced apart from the first depression and extending to only a second section of the periphery spaced apart from the first section of the periphery, said second depression having opposite edges on the end surface extending away from each other in a direction towards the second section of the periphery, wherein the method further comprises attaching another pre-formed TSP material layer within the second depression and extending to the second section of the periphery.

3. The method as recited in claim 1, wherein attaching comprises brazing said TSP material layer to the substrate end surface.

4. The method as recited in claim 1, wherein the TSP material layer extends only to the first section of the periphery.

5. The method as recited in claim 1, wherein said depression has a generally V-shape as viewed axially along a longitudinal axis of the substrate.

6. A method for forming a cutting element comprising:

obtaining a substrate having an end surface, a periphery, and a depression on the end surface extending to a first section of the periphery; and attaching a pre-formed thermally stable polycrystalline (TSP) material layer to said end surface within said depression and extending to said first section of the periphery, wherein said TSP material layer is a polycrystalline diamond layer selected from the group of polycrystalline diamond layers consisting essentially of polycrystalline diamond layers having at least some of a cobalt in such polycrystalline diamond layers leached and polycrystalline diamond layers formed with a thermally compatible silicone carbide binder, wherein attaching comprises fastening the TSP material layer to the substrate using a fastening member penetrating at least a portion of said TSP material layer.

7. The method as recited in claim 6, wherein fastening the TSP material layer to the substrate comprises engaging said TSP material layer and said substrate with said fastening member.

8. The method as recited in claim 7, wherein said fastening member is a rod.

9. A cutting element comprising:

a substrate comprising an end surface and a periphery, wherein the end surface extends to the periphery and includes a depression extending only to a first section of the periphery, said depression having opposite edges on the end surface extending away from each other in a direction toward the first section of the periphery; and a pre-formed thermally stable polycrystalline (TSP) material layer within the depression and extending to said first section of the periphery, wherein said TSP material layer is a polycrystalline diamond layer selected from the group of polycrystalline diamond layers consisting essentially of polycrystalline diamond layers having at least some of a cobalt in the polycrystalline diamond layers leached and polycrystalline diamond layers formed with a thermally compatible silicone carbide binder.

10. The cutting element as recited in claim 9, wherein said depression is a first depression and wherein the end surface comprises a second depression spaced apart from the first depression and extending only to a second section of the periphery spaced apart from the first section of the periphery, said second depression having opposite edges on the end surface extending away from each other in a direction towards the second section of the periphery, the cutting element further comprising another pre-formed TSP material layer within the second depression and extending to the second section of the periphery.

11. The cutting element as recited in claim 9, wherein the TSP material layer extends only to said first section of the periphery.

12. The cutting element as recited in claim 9, wherein at least a portion of the end surface is exposed and not covered by another material.

13. The method as recited in claim 9, wherein said depression has a generally V-shape as viewed axially along a longitudinal axis of the substrate.

14. A cutting element comprising:

a substrate comprising an end surface and a periphery, wherein the end surface extends to the periphery and includes a depression extending to a first section of the periphery;

a pre-formed thermally stable polycrystalline (TSP) material layer within the depression and extending to said first section of the periphery, wherein said TSP material layer is a polycrystalline diamond layer selected from the group of polycrystalline diamond layers consisting essentially of polycrystalline diamond layers having at least some of a cobalt in such polycrystalline diamond layers leached and polycrystalline diamond layers formed with a thermally compatible silicone carbide binder; and a fastening member penetrating at least a portion of the TSP material layer and fastening the TSP material layer to the substrate.

15. The cutting element as recited in claim 14, wherein the fastening member engages the TSP material layer and the substrate.

16. The cutting element as recited in claim 15, wherein the fastening member is a rod.

* * * * *

UNITED STATES PATENT AND TRADEMARK OFFICE

CERTIFICATE OF CORRECTION

PATENT NO. : 8,567,534 B2
APPLICATION NO. : 13/449243
DATED : October 29, 2013
INVENTOR(S) : Youhe Zhang et al.

It is certified that error appears in the above-identified patent and that said Letters Patent is hereby corrected as shown below:

In the Claims

| | |
|---|---|
| Column 10, Claim 9, line 50 | Delete "toward"<br>Insert -- towards -- |

Signed and Sealed this
Second Day of December, 2014

Michelle K. Lee

Michelle K. Lee
*Deputy Director of the United States Patent and Trademark Office*